US011584412B2

(12) United States Patent
Ferrell

(10) Patent No.: US 11,584,412 B2
(45) Date of Patent: Feb. 21, 2023

(54) TRAIN SYSTEM MONITORING

(71) Applicant: Siemens Mobility, Inc., New York, NY (US)

(72) Inventor: Corey J. Ferrell, Oxford, CT (US)

(73) Assignee: Siemens Mobility, Inc., New York, NY (US)

( * ) Notice: Subject to any disclaimer, the term of this patent is extended or adjusted under 35 U.S.C. 154(b) by 380 days.

(21) Appl. No.: 16/652,198

(22) PCT Filed: Nov. 13, 2017

(86) PCT No.: PCT/US2017/061230

§ 371 (c)(1),
(2) Date: Mar. 30, 2020

(87) PCT Pub. No.: WO2019/094035

PCT Pub. Date: May 16, 2019

(65) Prior Publication Data

US 2020/0247441 A1 Aug. 6, 2020

(51) Int. Cl.

| | |
|---|---|
| ***B61L 1/00*** | (2006.01) |
| ***B61L 15/00*** | (2006.01) |
| ***B61H 11/00*** | (2006.01) |
| ***B61L 27/57*** | (2022.01) |

(52) U.S. Cl.
CPC ..... *B61L 15/0081* (2013.01); *B61H 11/00* (2013.01); *B61L 27/57* (2022.01)

(58) Field of Classification Search
CPC ..... B61L 15/0081; B61L 27/57; B61H 11/00
See application file for complete search history.

(56) References Cited

U.S. PATENT DOCUMENTS

| | | | | |
|---|---|---|---|---|
| 4,379,990 | A * | 4/1983 | Sievers | H02J 7/0047 320/DIG. 13 |
| 2013/0200690 | A1 | 8/2013 | Rini et al. | |
| 2017/0066458 | A1* | 3/2017 | Huchrowski | B61L 15/0072 |
| 2018/0339720 | A1* | 11/2018 | Singh | G06V 10/751 |

OTHER PUBLICATIONS

PCT International Search Report and Written Opinion of International Searching Authority dated Oct. 10, 2018 corresponding to PCT International Application No. PCT/US2017/061230 filed Nov. 13, 2017.

* cited by examiner

*Primary Examiner* — Alesa Allgood

(57) ABSTRACT

An on board unit (OBU) of a train may determine that a trip or shift has ended and may initiate a train log-off procedure. The OBU may monitor for at least one alert condition during performance of the log-off procedure, the at least one alert condition comprising a condition wherein unauthorized train movement is possible. In response to detecting the at least one alert condition, the OBU may report the at least one alert condition and disable the train log-off procedure until the OBU determines that the at least one alert condition is resolved. In response to failing to detect the at least one alert condition and/or in response to determining that the at least one alert condition is resolved, the OBU may complete the train log-off procedure.

20 Claims, 3 Drawing Sheets

TRAIN SYSTEM MONITORING

BACKGROUND

Positive train control (PTC) systems and methods are used to monitor train operation and restrict or prevent train movement unless the train is authorized to move. PTC can enforce permanent and/or temporary speed restrictions, prevent collisions, automatically calculate breaking curves and/or apply brakes, and determine train location, for example. In so doing, PTC systems and methods can improve the safety of trains in operation.

DETAILED DESCRIPTION OF SEVERAL EMBODIMENTS

Systems and methods described herein may apply PTC concepts to trains that are not in operation. For example, a PTC system may include a human-machine interface (HMI) or cab display unit (CDU). A train operator can log onto the PTC system using the HMI or CDU to start train operation. When a completion or rest point is reached, the operator can secure the train and log out of the PTC system using the HMI or CDU. Systems and methods described herein may determine whether a log out is successful and/or monitor the train after log out, for example to safeguard against braking malfunctions.

Figure 1:
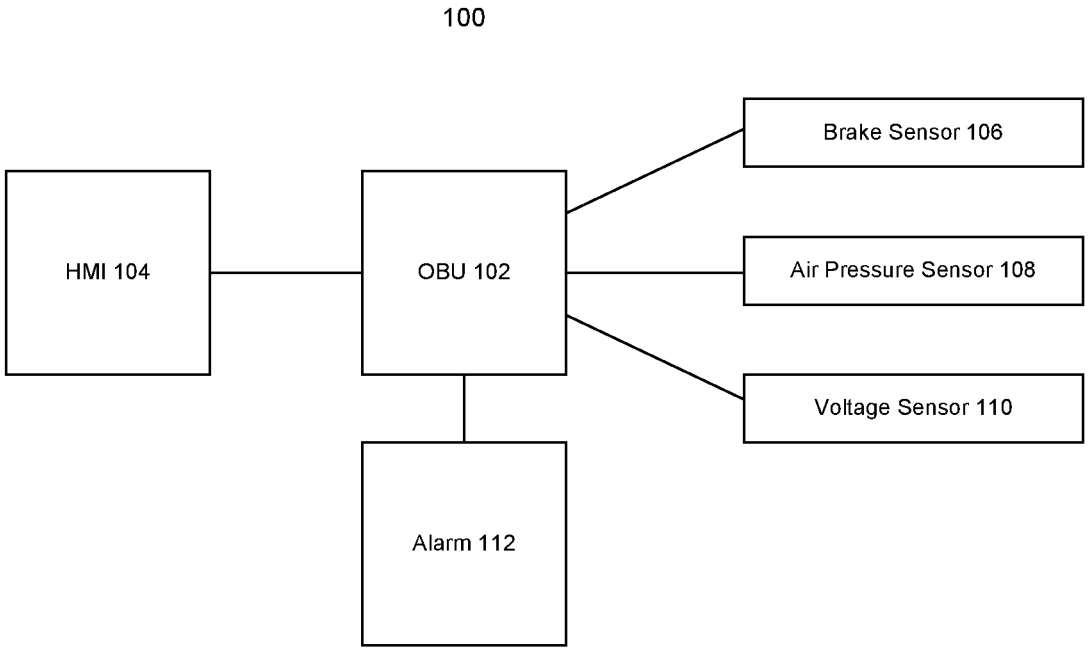
FIG. 1 is a block diagram of a positive train control system according to an embodiment of the invention.

FIG. 1 is a block diagram of a PTC system 100 according to an embodiment of the invention. System 100 may include an onboard unit (OBU) 102. OBU 102 may comprise at least one processor, memory, power supply, communication device, and/or other equipment. OBU 102 may include vital and/or non-vital equipment. OBU 102 may be configured to perform such tasks as communicating with off-train PTC elements (e.g., to receive track and/or speed information), calculate braking distances to comply with track conditions and/or restrictions, control train brakes and/or other systems, and/or monitor train systems.

OBU 102 may be in communication with an HMI 104. HMI 104 may include, for example, one or more user input devices (e.g., keyboard, touchscreen, keys, etc.) and/or one or more output devices (e.g., screen, touchscreen, speaker, etc.). HMI 104 may provide a user interface for interacting with system 100. A train operator may be able to log into HMI 104 and use HMI 104 to input commands to OBU 102 and/or other train systems. HMI 104 may also convey information to the train operator (e.g., from OBU 102 and/or other train systems).

OBU 102 may be in communication with one or more sensors configured to monitor one or more train functions. For example, sensors may include brake sensor 106, air pressure sensor 108, and/or voltage sensor 110. The sensors may be configured to monitor train braking equipment. For example, brake sensor 106 may detect whether mechanical brakes are being applied. Air pressure sensor 108 may detect whether air braking systems are pressurized. Voltage sensor may be configured to monitor battery (e.g., battery backup) charge. The illustrated sensors are examples only, and in other embodiments, system 100 may include additional and/or different sensors.

OBU 102 may be in communication with alarm 112. For example, OBU 102 may be configured to activate alarm 112 in response to detecting one or more conditions using one or more of the sensors (e.g., brake sensor 106, air pressure sensor 108, voltage sensor 110). Examples of conditions that may trigger alarm 112 are discussed below. In some embodiments, alarm 112 may be a component of HMI 104. For example, OBU 102 may cause HMI 104 to display information about the detected condition. In some embodiments, alarm 112 may be a component separate from HMI 104, such as a light, a speaker, or a combination thereof. In some embodiments, OBU 102 may communicate information about the detected condition using a combination of HMI 104 and separate alarm 112.

Figure 2:
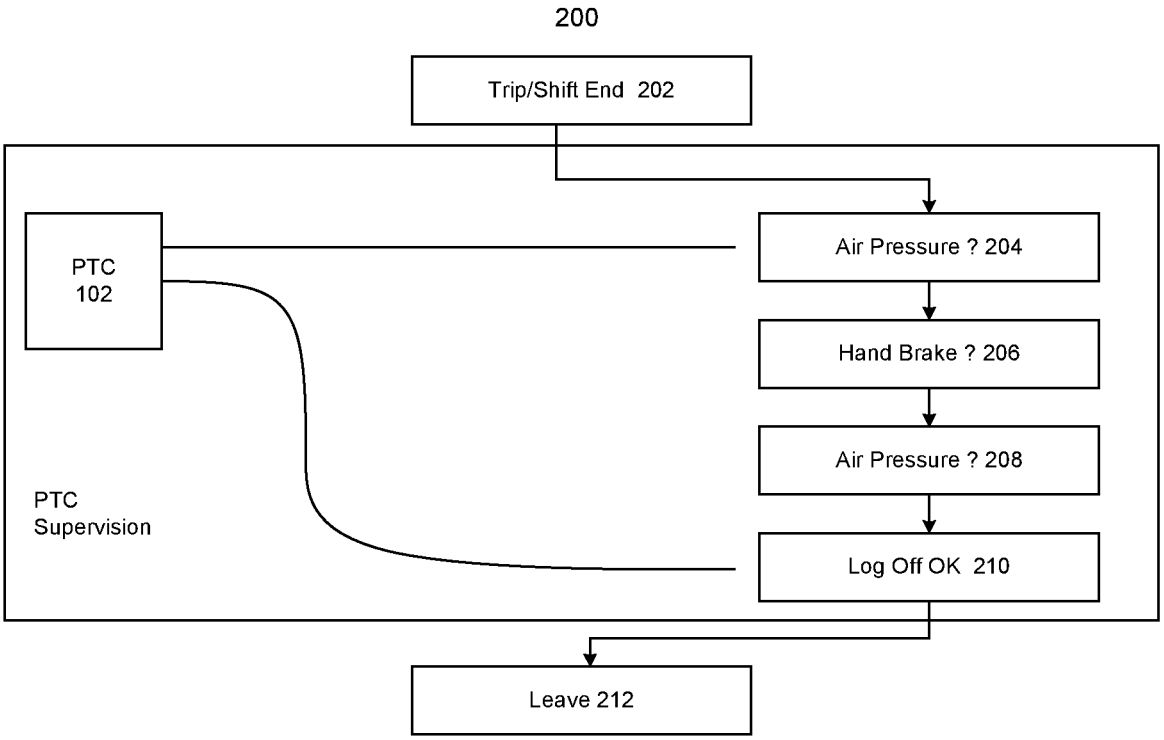
FIG. 2 is a train system monitoring process according to an embodiment of the invention.

FIG. 2 is a train system monitoring process 200 according to an embodiment of the invention. To avoid runaway trains or other undesirable conditions, trains may be required to have brakes set when they are not actively traveling, such as after the completion of a trip or while at a rest point. Process 200 may be used to monitor train brakes in situations wherein the brakes are required to be set.

At 202, a trip or shift may end. For example, OBU 102 may detect the trip or shift end when the train arrives at a predetermined destination and/or when a user indicates the trip or shift is ending by initiating a log-off procedure. OBU 102 may initiate the log-off procedure (e.g., in response to user command). When the trip or shift ends, one or more PTC system 100 components (e.g., OBU 102) may start monitoring train systems at 204-208 to ensure a safe log-off. One or more detected conditions may be alert conditions indicating an alert may be necessary. For example, the alert conditions may be conditions in which the train is capable of unauthorized movement (e.g., running away or otherwise moving independently and not in response to user command). In the event of an alert, a user may be unable to complete a log-off procedure until the problem causing the alert is remedied. Accordingly, the monitoring procedure may provide added safety compared with a procedure wherein log-off is not monitored.

At 204, OBU 102 may check whether air pressure in one or more train air braking systems is adequate. For example, in freight train operations in the United States, a minimum pressure of 130 to 145 PSI is maintained in a main reservoir in order to provide minimum braking force and comply with operating rules. OBU 102 may monitor air pressure using one or more air pressure sensors configured to measure air pressure in the reservoir. If OBU 102 detects an air pressure in the main reservoir below this minimum pressure (i.e., below a threshold value), OBU 102 may determine that the low air pressure constitutes an alert condition. OBU 102 may report the alert condition through HMI 104 and/or by activating alarm 112. OBU 102 may clear the alert when air pressure rises above the threshold value, for example in response to a user controlling the air brakes. The specific pressure of 130 to 145 PSI is presented as an example, and other threshold values for other minimum pressure levels may be established for other implementations.

At 206, OBU 102 may check whether a mechanical parking brake or "hand brake" is set. The hand brake may be configured to maintain stopping force in the absence of a running compressor to maintain air pressure in the air braking system. Accordingly, to prevent a runaway condition, the hand brake must be set before the train's electrical systems can be turned off. OBU 102 may monitor the hand brake setting using one or more sensors configured to determine whether the hand brake is set or disabled. If the hand brake is not set, OBU 102 may determine that the disabled hand brake constitutes an alert condition. OBU 102 may report the alert condition through HMI 104 and/or by activating alarm 112. OBU 102 may clear the alert when the user sets the hand brake. OBU 102 may disable shutdown of the train's electrical systems (e.g., the compressor) until the hand brake is set.

Malfunctions in the hand brakes can be handled by exception processes. For example, based on railroad operating rules, the primary handbrake for a train may be the locomotive's handbrake and possibly one or more rolling stock handbrakes. In the event of a mechanical fault in the handbrake or and electrical fault in the monitoring systems, alternate brakes in the train may be used. The specific number and spacing of alternate brakes may also be based on railroad operating rules. OBU 102 may designate the alternate brakes for use in response to detecting a mechanical or electrical fault. Another example of exception handling may provide for supervised engine operation to maintain air pressure until the handbrake fault is rectified. OBU 102 may operate the engine in a supervised operation state in response to detecting a mechanical or electrical fault.

At 208, after the hand brake is set, OBU 102 may check the air brakes (e.g., as described above with respect to step 204). OBU 102 may periodically and/or continuously check the air brakes until the log-off procedure is complete to safeguard against malfunction. If the hand brakes malfunction, active air brakes can keep the train from moving until alternate brakes can be activated.

At 210, if no alerts have been generated or if all alerts have been cleared as described above, OBU 102 may complete the log-off procedure. The log-off procedure may include powering down one or more train systems to place the train in a secure shutdown state. For example, because OBU 102 has determined the hand brake is set, it may be safe to power down the compressor maintaining air pressure in the air braking system, and OBU 102 may do so. As part of PTC, OBU 102 may report progress on log-off functions to a back office server (BOS). BOS may monitor these log-off functions in real-time. BOS monitoring may provide external supervision of the locomotive and crew actions within railroad operation centers. At 212, with the trip or shift completed, the operator may leave the train safely, and the train may be in a secure shutdown state.

Figure 3:
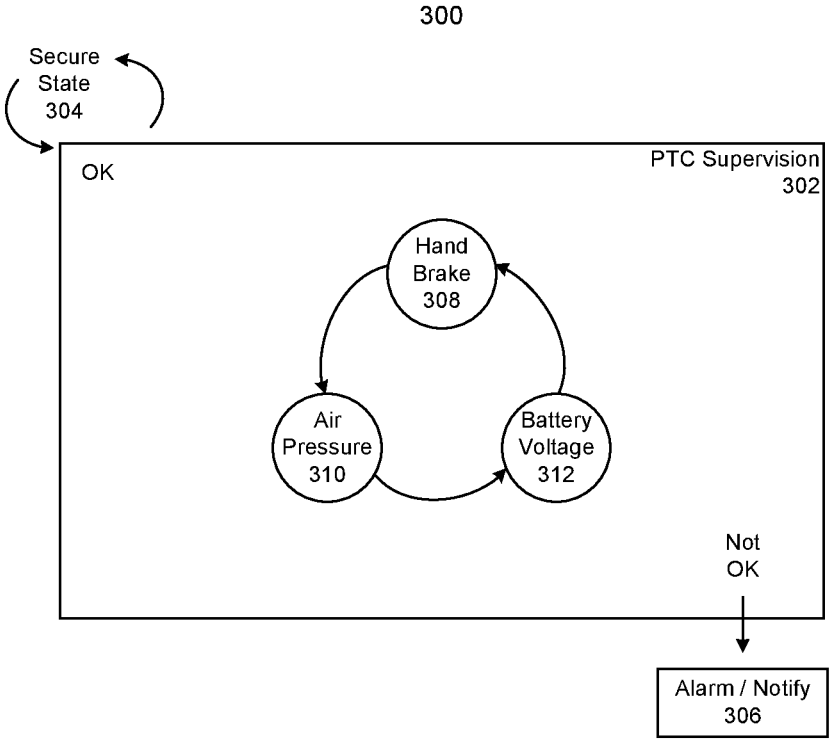
FIG. 3 is a train system state diagram according to an embodiment of the invention.

FIG. 3 is a train system state diagram 300 according to an embodiment of the invention. State diagram 300 illustrates battery voltage monitoring that may be performed by OBU 102 when a train's engine has been shut down. For example, when the train is in a secure shutdown state 304, OBU 102 may periodically or continuously perform a PTC supervision check 302 to determine whether the shutdown state remains secure. During the supervision check 302, OBU 102 may check whether the hand brake is set 308 (e.g., according to process 206 described above). OBU 102 may check whether the air pressure for the air brakes is at an appropriate level 310 (e.g., according to process 204 described above). OBU 102 may check whether battery voltage is above a threshold level 312. For example, the train may require an adequately-charged battery to power OBU 102 to perform future supervision checks 302 and/or to test/operate equipment such as the hand brake. If any of these checks indicate an unsafe condition (e.g., batter, low, hand brake not set and air pressure below threshold level), OBU 102 may determine that an alert condition is present and may report the alert condition 306 (e.g., through HMI 104 and/or by activating alarm 112).

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A monitoring method comprising:

determining, by an on board unit (OBU) of a train, that a trip or shift has ended;

initiating, by the OBU, a train log-off procedure;

monitoring, by the OBU, for at least one alert condition during performance of the log-off procedure, the at least one alert condition comprising a condition wherein unauthorized train movement is possible;

in response to detecting the at least one alert condition, reporting, by the OBU, the at least one alert condition and disabling the train log-off procedure until the OBU determines that the at least one alert condition is resolved;

in response to failing to detect the at least one alert condition and/or in response to determining that the at least one alert condition is resolved, completing, by the OBU, the train log-off procedure;

powering down one or more train system(s) to place the train in a secure shutdown state; and periodically performing a supervision check, by the OBU, to determine whether the shutdown state remains secure, the supervision check comprising a hand brake check, an air pressure check and a battery voltage check.

2. The monitoring method of claim 1, wherein completing the log-off procedure comprises deactivating, by the OBU, at least one air braking system.

3. The monitoring method of claim 1, wherein the at least one alert condition comprises an inadequate charge in at least one battery.

4. The monitoring method of claim 1, further comprising reporting a status of the log-off procedure to a back office server.

5. The monitoring method of claim 1, wherein the at least one alert condition comprises an inadequate air pressure in at least one air braking system.

6. The monitoring method of claim 5, wherein the monitoring comprises monitoring, by the OBU, at least one air pressure sensor.

7. The monitoring method of claim 6, wherein the monitoring comprises periodically checking the at least one air pressure sensor.

8. The monitoring method of claim 1, wherein the at least one alert condition comprises an unset hand brake.

9. The monitoring method of claim 8, wherein the monitoring comprises determining, by the OBU, whether at least one hand brake is set.

10. The monitoring method of claim 8, further comprising in response to detecting the at least one alert condition, controlling, by the OBU, at least one air braking system to maintain air pressure.

11. The monitoring method of claim 8, wherein the reporting comprises instructing, by the OBU, a user to activate at least one alternate hand brake.

12. A monitoring system comprising:

an on board unit (OBU) of a train configured to:

determine that a trip or shift has ended;

initiate a train log-off procedure;

monitor for at least one alert condition during performance of the log-off procedure, the at least one alert condition comprising a condition wherein unauthorized train movement is possible;

in response to detecting the at least one alert condition, report the at least one alert condition and disable the train log-off procedure until the OBU determines that the at least one alert condition is resolved;

in response to failing to detect the at least one alert condition and/or in response to determining that the at least one alert condition is resolved, complete the train log-off procedure;

power down one or more train system(s) to place the train in a secure shutdown state; and periodically perform a supervision check to determine whether the shutdown state remains secure, the supervision check comprising a hand brake check, an air pressure check and a battery voltage check.

13. The monitoring system of claim 12, wherein completing the log-off procedure comprises deactivating at least one air braking system.

14. The monitoring system of claim 12, wherein the at least one alert condition comprises an inadequate air pressure in at least one air braking system.

15. The monitoring system of claim 14, wherein the OBU is configured to monitor for the at least one alert condition by monitoring at least one air pressure sensor.

16. The monitoring system of claim 15, wherein the monitoring comprises periodically checking the at least one air pressure sensor.

17. The monitoring system of claim 12, wherein the at least one alert condition comprises an unset hand brake.

18. The monitoring system of claim 17, wherein the OBU is configured to monitor for the at least one alert condition by determining whether at least one hand brake is set.

19. The monitoring system of claim 17, wherein the OBU is further configured to, in response to detecting the at least one alert condition, control at least one air braking system to maintain air pressure.

20. The monitoring system of claim 17, wherein the OBU is configured to report the at least one alert condition by instructing a user to activate at least one alternate hand brake.

* * * * *